US011306459B2

(12) United States Patent
Eckrote et al.

(10) Patent No.: US 11,306,459 B2
(45) Date of Patent: Apr. 19, 2022

(54) ACCESSORY MOUNTING SYSTEM FOR A WORK VEHICLE

(71) Applicant: CNH Industrial America LLC, New Holland, PA (US)

(72) Inventors: Richard Carter Eckrote, Wichita, KS (US); Alexander Fey, Wichita, KS (US); Brady Lewis, Wichita, KS (US)

(73) Assignee: CNH Industrial America LLC

( * ) Notice: Subject to any disclaimer, the term of this patent is extended or adjusted under 35 U.S.C. 154(b) by 196 days.

(21) Appl. No.: 16/707,573

(22) Filed: Dec. 9, 2019

(65) Prior Publication Data

US 2020/0115883 A1 Apr. 16, 2020

Related U.S. Application Data

(62) Division of application No. 15/392,250, filed on Dec. 28, 2016, now abandoned.

(51) Int. Cl.
*E02F 3/76* (2006.01)
*E02F 3/627* (2006.01)
*E02F 5/32* (2006.01)

(52) U.S. Cl.
CPC ..... *E02F 3/7604* (2013.01); *E02F 3/627* (2013.01); *E02F 5/32* (2013.01)

(58) Field of Classification Search
CPC . E02F 3/7604; E02F 3/80; E02F 3/627; E02F 3/283; E02F 3/28; E02F 3/301; E02F 3/32; E02F 3/34; E02F 5/32; E02F 9/0858; E02F 9/0875
See application file for complete search history.

(56) References Cited

U.S. PATENT DOCUMENTS 2,899,760 A * 8/1959 Armington ..... E02F 3/7604 172/777
2,943,407 A * 7/1960 Long ..... E02F 3/7613 172/821
3,074,190 A * 1/1963 Wahl ..... E02F 5/32 172/136
3,243,905 A * 4/1966 Ulrich ..... E02F 3/4133 37/406
3,336,082 A * 8/1967 Bodine, Jr. ..... E02F 5/326 299/14
3,539,022 A * 11/1970 Berg ..... E02F 3/80 172/819
3,623,246 A * 11/1971 Skomial ..... E02F 3/083 37/348

(Continued)

*Primary Examiner* — Adam J Behrens
(74) *Attorney, Agent, or Firm* — Peter Zacharias; Patrick Sheldrake

(57) ABSTRACT

An accessory mounting system for a work vehicle includes a first mount extending from a lateral side of a body of the work vehicle, in which the first mount is configured to couple to a first end of a rotatable component to rotatably couple the rotatable component to the body of the work vehicle. Further, the accessory mounting system for includes a cover assembly having a cover, in which the cover assembly is coupled to the lateral side of the body of the work vehicle, and at least a portion of the cover is positioned laterally outward from the first mount such that the first end of the rotatable component is disposed between the lateral side of the body of the work vehicle and the portion of the cover while the first end of the rotatable component is coupled to the first mount.

20 Claims, 6 Drawing Sheets

(56) References Cited

U.S. PATENT DOCUMENTS 3,887,015 A 6/1975 Kelley
3,907,333 A 9/1975 Gianessi et al.
4,252,376 A 2/1981 Gurries
4,278,141 A * 7/1981 Oswald ..... B60B 37/00 180/24.12
4,321,970 A 3/1982 Thigpen
4,621,973 A * 11/1986 Langenfeld ..... E02F 3/627 414/686
5,000,650 A * 3/1991 Brewer ..... E02F 3/434 172/812
5,531,561 A * 7/1996 Rae ..... E02F 3/6273 414/686
5,732,781 A * 3/1998 Chambers ..... E02F 3/627 172/825
5,895,199 A * 4/1999 Baumert, III ..... E02F 3/627 414/686
6,135,223 A * 10/2000 Miyachi ..... E02F 9/0891 180/69.21
6,171,050 B1 * 1/2001 Johnson ..... E02F 3/34 414/685
6,283,220 B1 * 9/2001 Carter ..... B62D 1/24 169/24
6,311,784 B1 11/2001 Clarke et al.
8,292,000 B2 * 10/2012 Takami ..... E02F 3/7627 172/813
8,408,862 B1 * 4/2013 Westendorf ..... E02F 9/2275 414/722
9,057,179 B1 * 6/2015 Kubas ..... A01B 59/06
10,077,542 B2 * 9/2018 Emmerson ..... E02F 3/627
2004/0091347 A1 * 5/2004 Hackett ..... E02F 3/627 414/685
2005/0175438 A1 * 8/2005 Stender ..... E02F 3/627 414/680
2008/0236953 A1 * 10/2008 Kisse ..... E02F 3/3414 187/237
2016/0090710 A1 * 3/2016 Takemura ..... E02F 3/422 414/685

* cited by examiner

ACCESSORY MOUNTING SYSTEM FOR A WORK VEHICLE

CROSS-REFERENCE TO RELATED APPLICATION

This application is a divisional of U.S. patent application Ser. No. 15/392,250, entitled "ACCESSORY MOUNTING SYSTEM FOR A WORK VEHICLE," filed Dec. 28, 2016, which is hereby incorporated by reference in its entirety.

BACKGROUND

The present disclosure relates generally to an accessory mounting system for a work vehicle.

Certain work vehicles (e.g., tractors, harvesters, skid steers, or the like) may be used to plow a field, till land, move earth, or accomplish other construction and/or agricultural operations. For example, one or more implements may be coupled to the work vehicle to accomplish such agricultural and/or construction operations. In such cases, the implement may be coupled to the work vehicle via various members (e.g. hoses, hydraulic cylinders, pivot arm, or the like). Additionally, certain members are lubricated or oiled to promote their longevity. During operation these members are exposed to dirty environments causing dirt and/or other contaminants to collect on the oiled (e.g., lubricated) members. The duration between regular maintenance of the members may be reduced, thereby decreasing maintenance costs.

BRIEF DESCRIPTION

In one embodiment, an accessory mounting system for a work vehicle includes a first mount extending from a lateral side of a body of the work vehicle, in which the first mount is configured to couple to a first end of a rotatable component to rotatably couple the rotatable component to the body of the work vehicle. Further, the accessory mounting system includes a cover assembly having a cover, in which the cover assembly is coupled to the lateral side of the body of the work vehicle, and at least a portion of the cover is positioned laterally outward from the first mount such that the first end of the rotatable component is disposed between the lateral side of the body of the work vehicle and the portion of the cover while the first end of the rotatable component is coupled to the first mount.

In another embodiment, an accessory mounting system for a work vehicle includes a tubing system positioned on a lateral side of a body of the work vehicle. The accessory mounting system also includes a cover assembly including a cover, in which the cover assembly is coupled to the lateral side of the body of the work vehicle, and at least a portion of the cover is positioned laterally outward from the tubing system such that a portion of the tubing system is disposed between the lateral side of the body of the work vehicle and the portion of the cover.

In a further embodiment, a cover assembly for a work vehicle, includes a cover coupled to a lateral side of a body of the work vehicle, in which a portion of the cover is configured to be positioned laterally outward from an element such that the element is disposed between the lateral side of the body of the work vehicle and the portion of the cover, and the element includes a first end of a rotatable component, a portion of a tubing system, or a combination thereof. Further, the cover assembly for the work vehicle includes a deflector configured to be positioned forward of the element relative to a direction of travel of the work vehicle.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
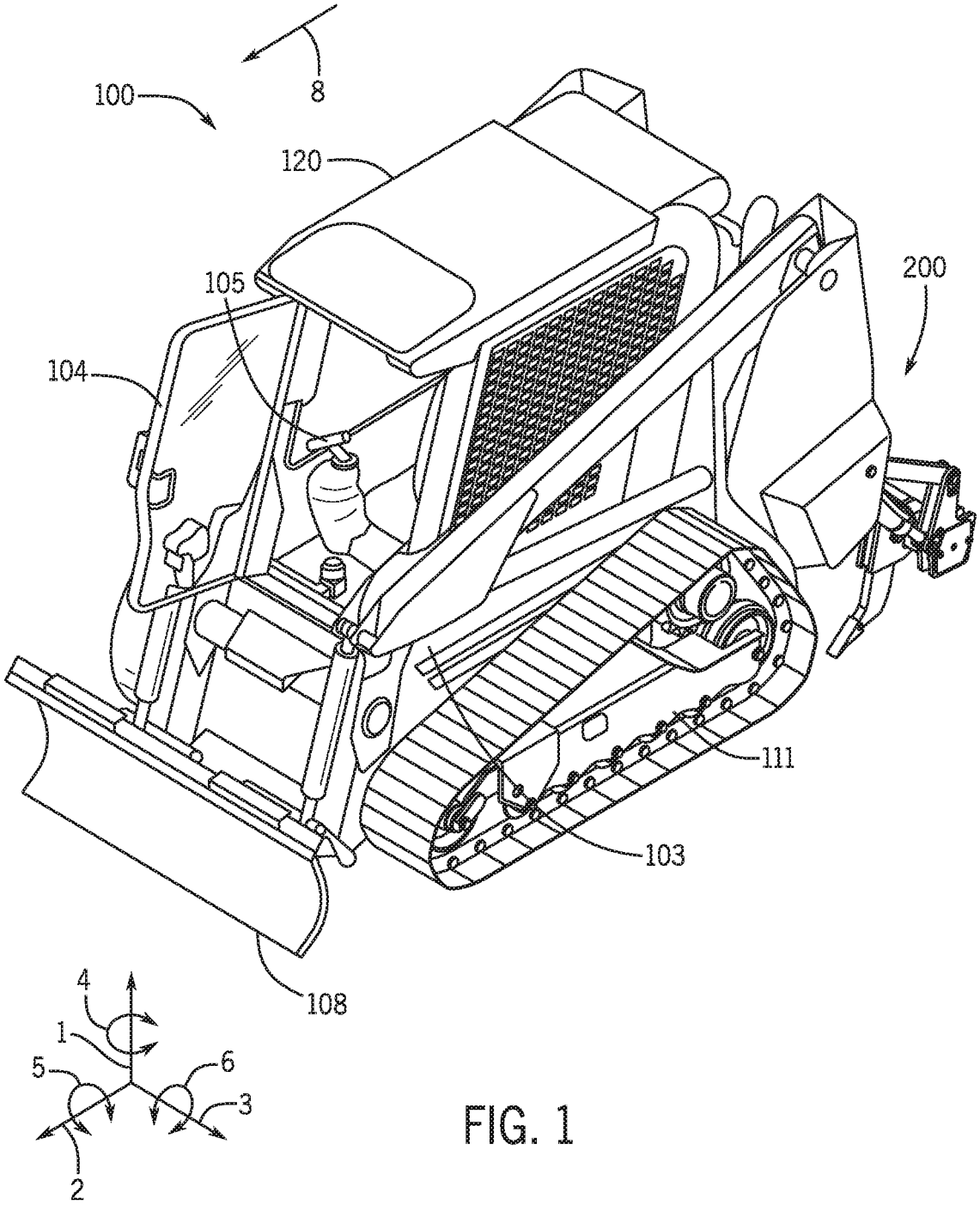
FIG. 1 is a front perspective view of an embodiment of a work vehicle that includes an accessory mounting system.

Turning to the drawings, FIG. 1 is a front perspective view of an embodiment of a work vehicle 100 that includes an accessory mounting system. In the illustrated embodiment, the work vehicle 100 is a skid steer. However, it should be appreciated that the accessory mounting system disclosed herein may be utilized on other work vehicles, such as but not limited to on-road trucks, tractors, harvesters, and construction equipment. The work vehicle 100 may include a front tool 108 located on a front portion of the work vehicle relative to the direction of travel 8 and a rear tool located a rear portion of the work vehicle relative to the direction of travel 8. As such, the illustrated work vehicle 100 includes a front tool 108 and a rear tool (e.g., the accessory assembly 200), but in other configurations, the work vehicle 100 may include only a rear tool or a front tool. In the illustrated embodiment, the work vehicle 100 includes a cab 120 and a chassis 103. In certain embodiments, the chassis 103 is configured to house a motor (e.g., diesel engine, etc.), a hydraulic system (e.g., including a pump, valves, reservoir, etc.), and other components (e.g., an electrical system, a cooling system, etc.) that facilitate operation of the work vehicle. In addition, the chassis 103 is configured to support the cab 120 and tracks 111. The tracks 111 may be driven to rotate by the motor and/or by component(s) of the hydraulic system (e.g., hydraulic motor(s), etc.).

The cab 120 is configured to house an operator of the work vehicle 100. Accordingly, various controls, such as the illustrated hand controller 105, are positioned within the cab 120 to facilitate operator control of the work vehicle 100. For example, the controls may enable the operator to control rotational speed of the tracks 111, thereby facilitating adjustment of the speed and/or direction of travel 8 of the work vehicle 100. In the illustrated embodiment, the cab 120 also includes a door 104 to facilitate ingress and egress of the operator from the cab 120. In addition, the controls may facilitate operator control of the front and rear tools. While the illustrated work vehicle 100 includes a blade as the front tool, it should be appreciated that in alternative embodiments, the work vehicle may include a tilling assembly or a gripper assembly, among others, as the front tool. Furthermore, while the illustrated work vehicle 100 includes the accessory assembly 200 as the rear tool, it should be appreciated that in alternative embodiments, the work vehicle may include a tilling assembly or a gripper assembly, among others, as the rear tool.

As discussed in detail below, the work vehicle 100 may include an accessory mounting system configured to couple an accessory assembly (e.g., including the rear tool) to the work vehicle. The accessory mounting system may include a cover assembly configured to block dirt and/or other contaminants from impacting the hoses and/or the components of the accessory assembly, thereby reducing maintenance costs (e.g., by reducing contamination of the lubricant etc.). The accessory mounting system may enable the components of the necessary assembly to rotate relative to the chassis 103 about a lateral axis 3 in pitch 6 via a pivotal attachment. Furthermore, the accessory mounting system may substantially block rotation of the components of the accessory assembly relative to the chassis 103 about a longitudinal axis 2 in roll 5 and about a vertical axis 1 in yaw 4.

Figure 2:
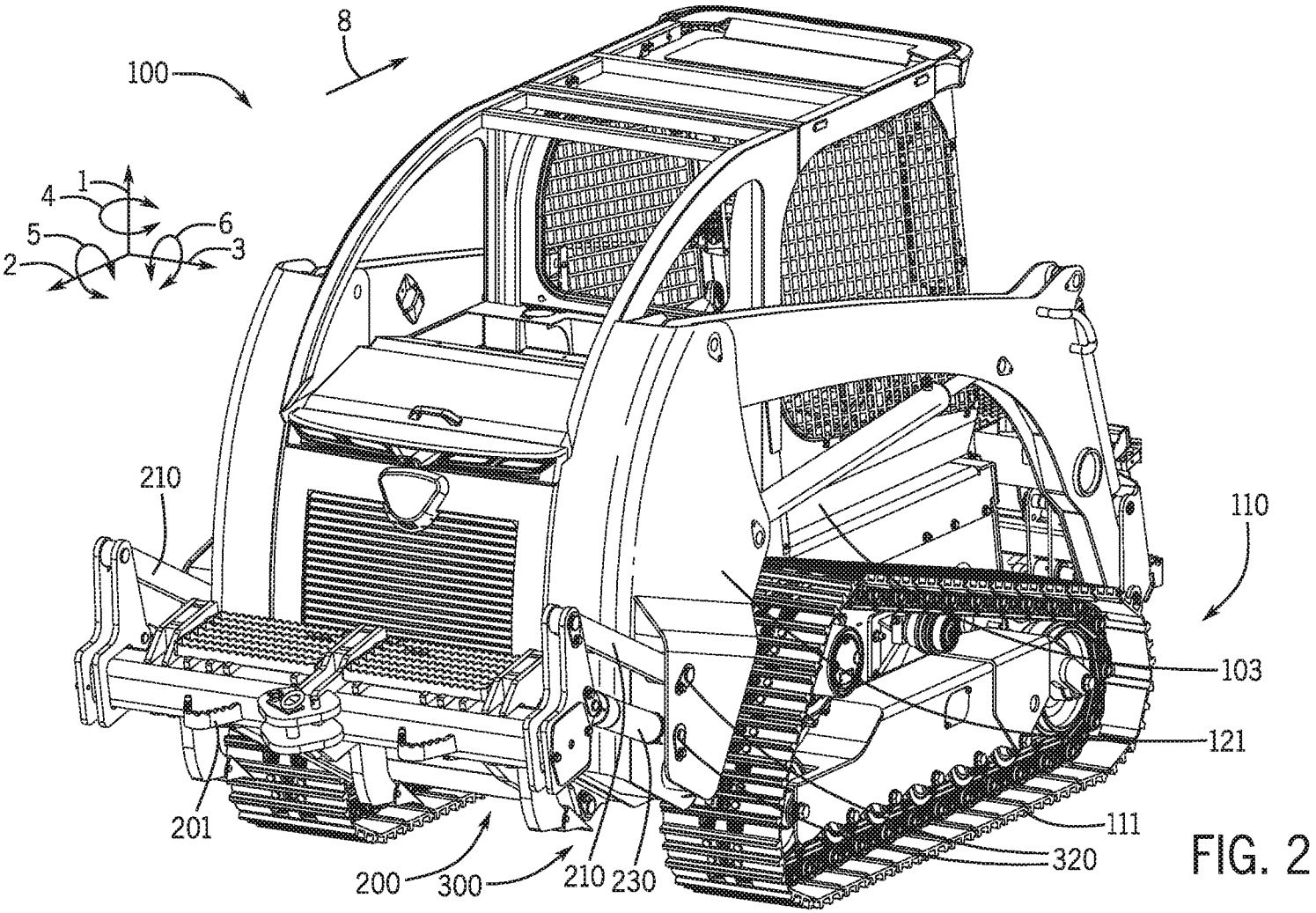
FIG. 2 is a rear perspective view of the work vehicle of FIG. 1, including the accessory mounting system.

FIG. 2 is a rear perspective view of the work vehicle of FIG. 1, including an accessory mounting system. The work vehicle 100 includes the chassis 103, the accessory assembly 200 and a track assembly 110, which is configured to advance and direct the work vehicle 100. The work vehicle 100 may include a front tool located at a forward end of the work vehicle relative to the direction of travel 8. The illustrated work vehicle 100 also includes the rear tool, but in other configurations, the work vehicle 100 may include only a rear tool or only a front tool. While the illustrated work vehicle 100 includes a track assembly 110 having two tracks 111 positioned on opposite lateral sides of the work vehicle 100, it should be appreciated that in alternative embodiments, the work vehicle may include tracks, wheels, or a combination thereof. Furthermore, the accessory assembly 200 includes a ripper 201, hydraulic cylinders 230, and arms 210. Each arm 210 and each hydraulic cylinder 230 are pivotally attached via a respective pivot joint to the work vehicle 100 at a respective lateral side 121 of the work vehicle 100. It should be appreciated that in additional embodiments, the arm(s) and/or hydraulic cylinder(s) may be attached to the lateral side(s) of the work vehicle via a shaft, a rail system, or any other suitable attachment.

As discussed in detail below, in the current embodiment, the accessory assembly 200 is attached to each lateral side 121 of the work vehicle 100 via pivot joints. In the illustrated embodiment, a first end of each hydraulic cylinder 230 is pivotally coupled to a respective lateral side of the chassis via a respective pivot joint. In addition, each arm 210 is pivotally coupled to a respective lateral side of the chassis via a respective pivot joint. Accordingly, the arms 210 and hydraulic cylinders 230 may rotate relative to the chassis 103 about the lateral axis 3 in pitch 6 via the respective pivot joints, which are coupled to the first end of each hydraulic cylinder 230 and the first end of each arm 210. The pivotal attachment configuration of the first ends of the hydraulic cylinders 230 and the arms 210 may substantially reduce the rotation of the ripper 201 relative to the chassis 103 about the longitudinal axis 2 in roll 5 and about the vertical axis 1 in yaw 4. The arms 210 and the hydraulic cylinders 230 enable the ripper 201 to translate along the vertical axis 3. The hydraulic cylinders 230 may control the vertical position of the ripper 201 along the vertical axis 1. In further embodiments, the pivot joints between the ripper 201 and the chassis 103 may be any suitable type of rotatable connectors (e.g., slip rings, swivels, rotatable pins, etc.). Furthermore, other suitable actuators (e.g., screw jacks, electric motors, pneumatic actuators, etc.) may be used instead of or in addition to the hydraulic cylinders 230.

Because of the proximity of the tracks 111 to the pivotal attachments of the first ends of the hydraulic cylinders 230 and the arms 210, the tracks 111 my expel debris (e.g., dirt, mud, etc.) towards the pivotal attachments. The pivot joint(s) (e.g., mount) attaching the rotatable component(s) to the lateral side of the body of the work vehicle may be disposed between the lateral side 121 of the body of the work vehicle 100 and a portion of a cover assembly. In the illustrated embodiment, the rotatable components include an arm 210 and hydraulic cylinder 230 pivotally attach the ripper 201 to the lateral side 121 of the body of the work vehicle 100. Accordingly, the cover assembly 300, which covers and houses the mounting components (e.g., pivot joints, first ends of the arms and cylinders, hoses, etc.) that attach the ripper 201 to the lateral side 121 of work vehicle 100, may block the debris from impacting the connectors. As a result, preventing dirt from coming into contact with oiled and/or lubricated members, thereby reducing maintenance costs.

Figure 3:
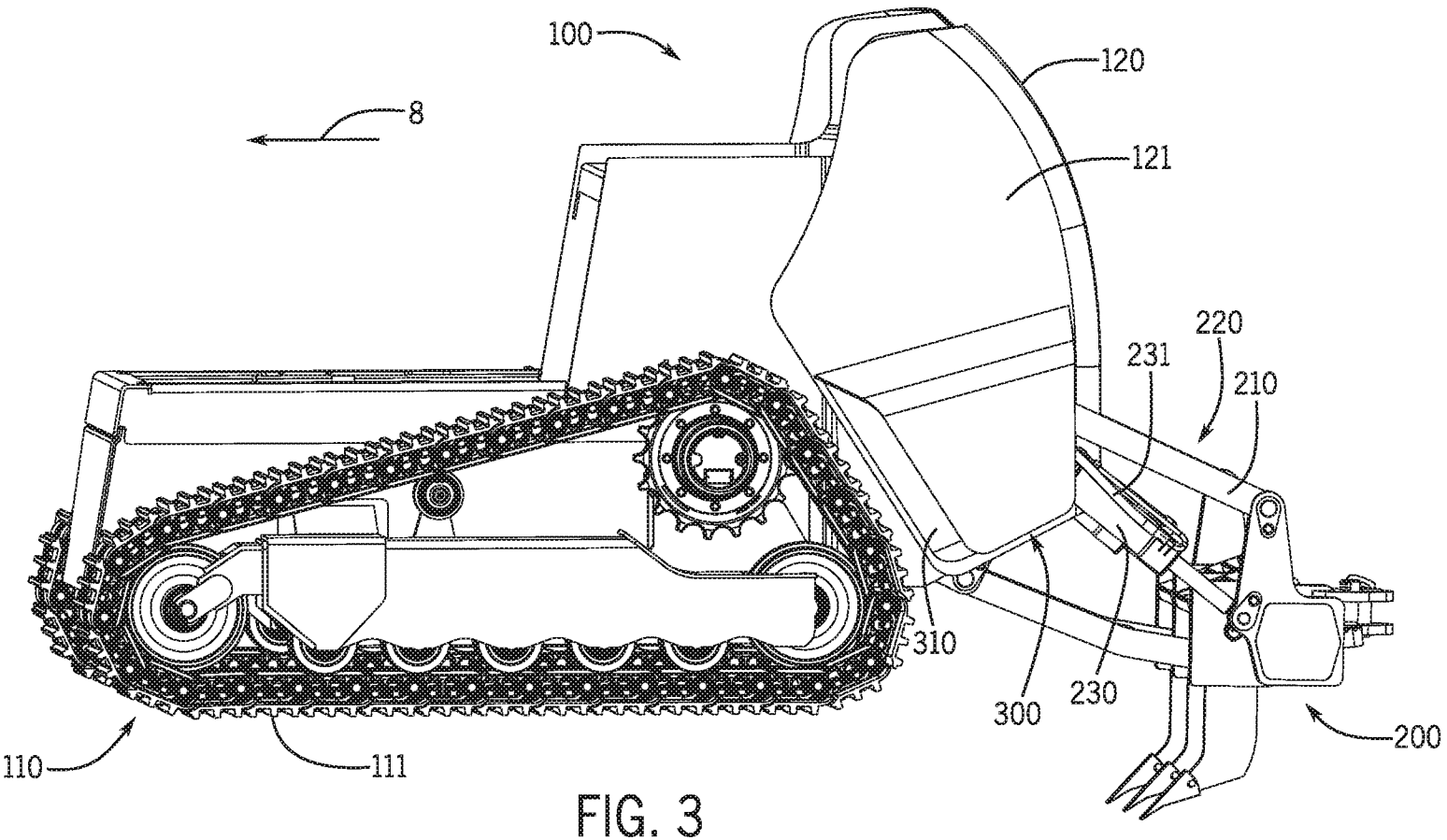
FIG. 3 is a side view of the work vehicle of FIG. 1, including the accessory mounting system.

FIG. 3 is a side view of the work vehicle of FIG. 1 including the accessory mounting system 220. As illustrated, the work vehicle 100 has a lateral side 121 to which the cover assembly 300 is attached. The cover assembly 300 may be coupled to the lateral side 121 via welding, riveting, or brazing, among other suitable coupling methods. Furthermore, the cover assembly 300 includes a deflector 310 positioned forward of the first end of the rotatable component relative to the direction of travel 8 of the work vehicle. The deflector 310 may be attached to the lateral side 121 via welding, riveting, or brazing, among other suitable coupling methods. The deflector 310 may be oriented at various angles (e.g., between 15 degrees to 135 degrees) relative to a plane formed by the lateral side 121. Functionally, the deflector 310 serves to block debris (e.g., discharged from the tracks) from contacting the hydraulic cylinders 230, the hydraulic hoses 231, and arms 210.

Figure 4:
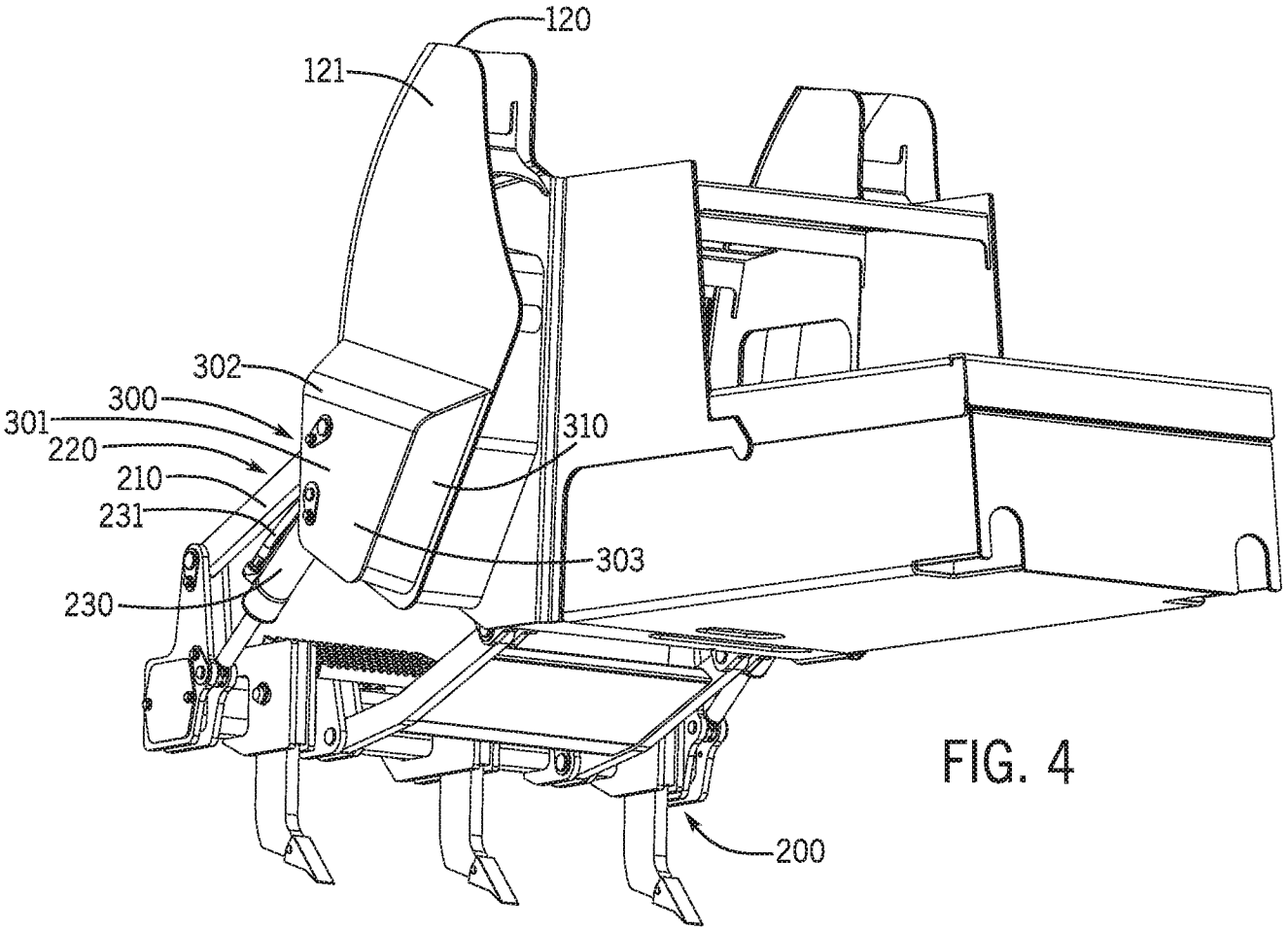
FIG. 4 is a perspective view of the accessory mounting system, according to an embodiment of the present disclosure.

FIG. 4 is a perspective view of the accessory mounting system 220, according to an embodiment of the present disclosure. The accessory mounting system 220 includes the cover assembly 300. In the illustrated embodiment, the cover assembly 300 includes the cover 303, in which a first portion 301 of the cover 303 is substantially flat, and a second portion 302 of the cover (e.g., an angled section) extends laterally outward from the lateral side 121 of the body of the work vehicle to the first portion 301 of the cover that is substantially flat. The deflector 310 is coupled to the lateral side 121 of the body of the work vehicle and to the cover 303 (e.g., via welding, riveting, etc.). Furthermore, the deflector 310 blocks debris from impacting the arm 210, the hydraulic cylinder 230, and the hydraulic hoses 231.

Figure 5:
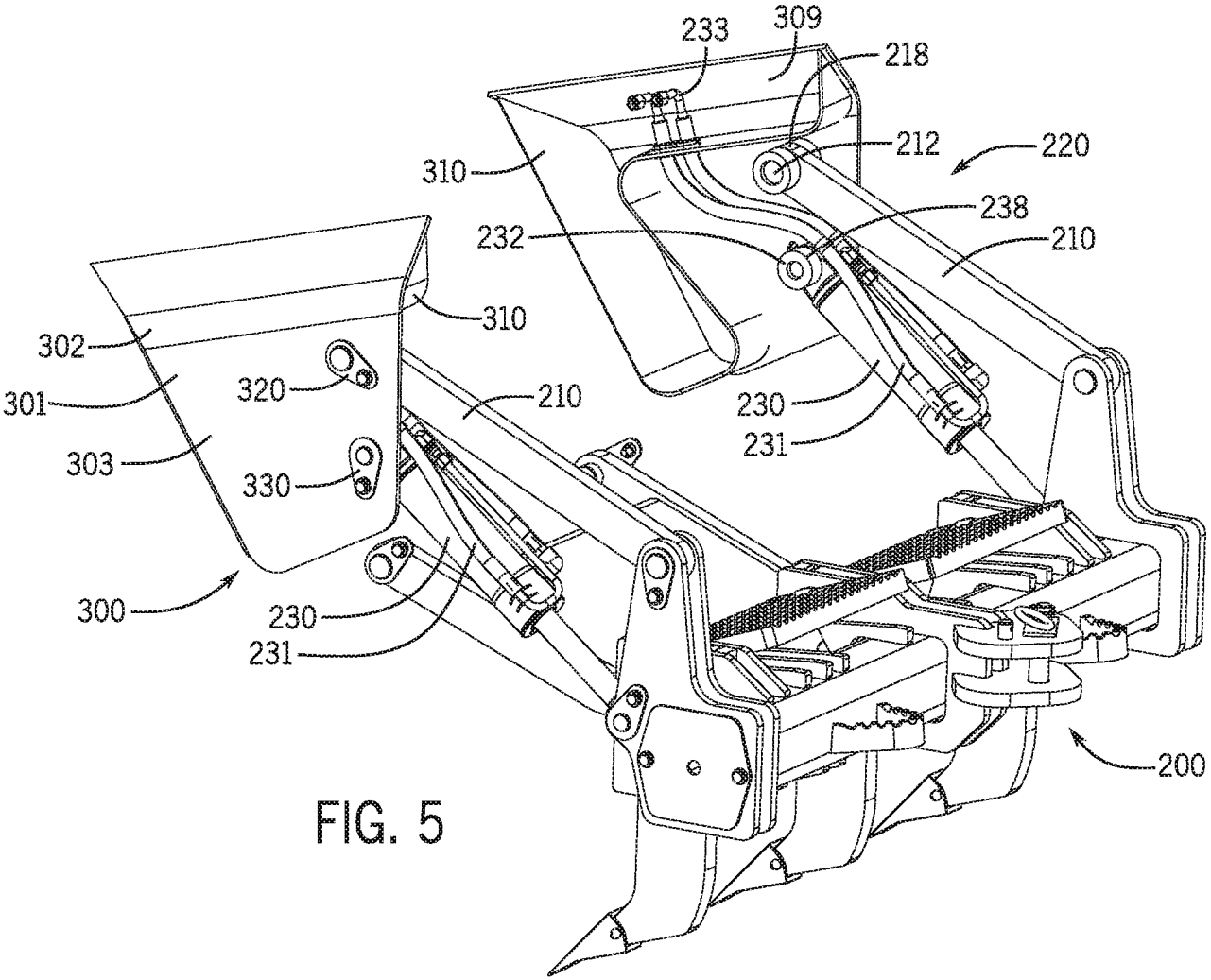
FIG. 5 is another perspective view of the accessory mounting system of FIG. 4.

FIG. 5 is another perspective view of the accessory mounting system 220 of FIG. 4, which is used to mount the accessory assembly 200 to the work vehicle. As illustrated, two cover plates 303 and two deflectors 310 are coupled to the accessory assembly 200. The cover assembly 300 includes an arm mount 320 and a hydraulic cylinder mount 330. The arm mount 320 has a substantially similar structure to that of the hydraulic cylinder mount 330, as explained in detail below. The hydraulic cylinder 230 is attached at its first end 238 to the lateral side of the body of the work vehicle via mount 232. In addition, the arm 210 is coupled at its first end 218 to the lateral side of the body of the work vehicle via pin 212. In the illustrated embodiment, mounts 232 and 330 enable the hydraulic cylinders 230 to rotate, while mounts 212 and 320 enable the arms 210 to rotate. In further embodiments, the mounts may be modified to control (e.g., limit) rotation. In certain embodiments, the mounts on the cover may be omitted.

Furthermore, the deflector 310 follows the front edge of the cover 303 and then curves inside the cover 303 to form a sweeping shape. The cover and the deflector form part of a housing between the deflector 310, the cover 303, and the lateral side of the body of the work vehicle. In the current embodiment, the sweeping shape formed by the deflector 310 is an "L-like" shape after tracing the front edge of the cover 303, but in other embodiments the deflector may form a rectangular, triangular, or zig-zag shape, for example, such that a housing is formed between the deflector 310, the cover 303, and the lateral side of the body of the work vehicle. Connectors 233 of the hydraulic lines 231 are disposed within the housing 309 and may be attached to corresponding connectors on the lateral side of the body of the work vehicle. It should be appreciated that in additional embodiments, the housing formed between the deflector 310, the cover 303, and the lateral side of the body of the work vehicle may house any number of suitable components for additional protection from the dirty operating environment of the work vehicle. Further, the connectors may be entirely enclosed within the housing formed between the deflector 310, a portion of the cover 303, and the lateral side of the body of the work vehicle. As such, the housing may be large enough to house the connectors and/or other suitable components.

Figure 6:
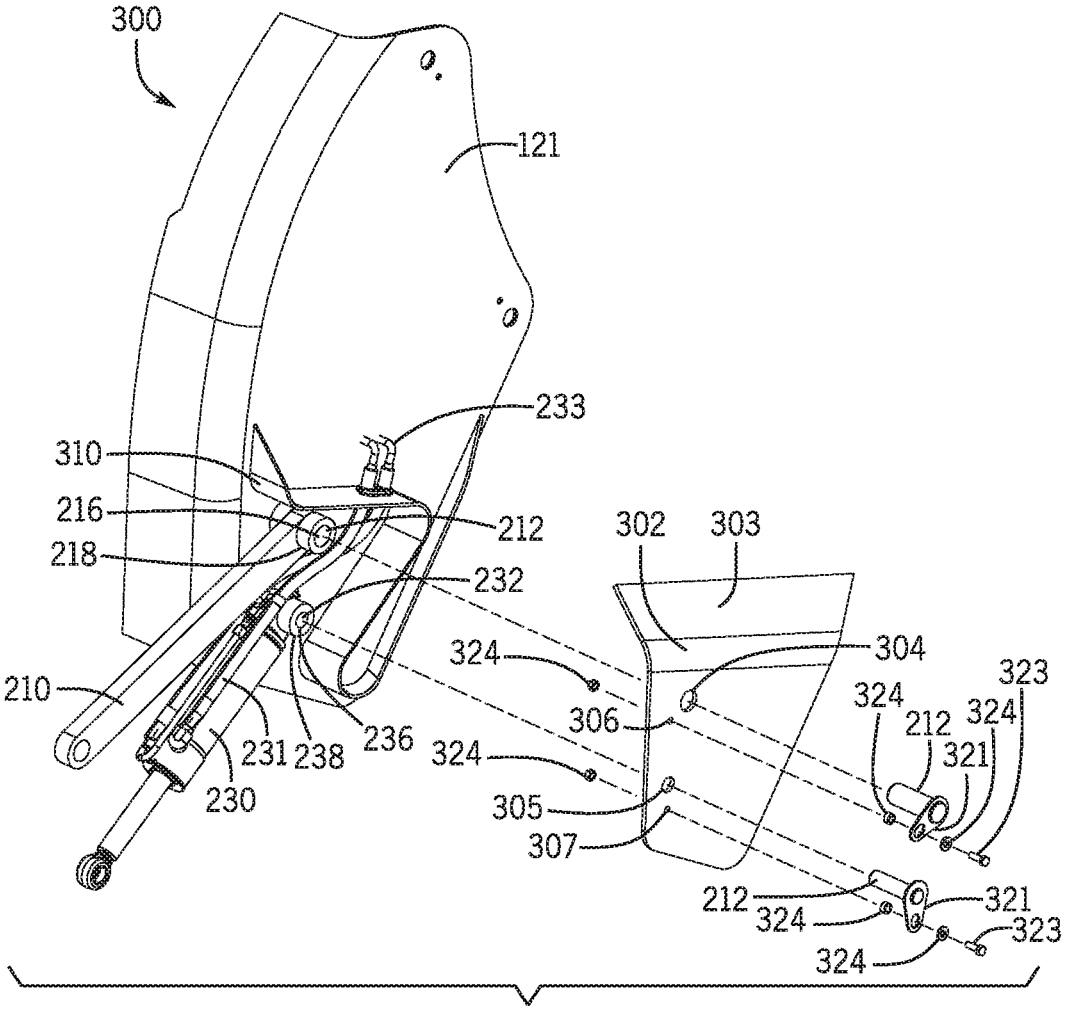
FIG. 6 is an exploded view of a portion of the accessory mounting system of FIG. 4, including a cover assembly.

FIG. 6 is an exploded view of a portion of the accessory mounting system 220 of FIG. 4, including the cover assembly. In the illustrated embodiment, the deflector 310 is coupled to the lateral side 121 of the body of the work vehicle. The angle of the sweeping surface of the deflector is about 90 degrees relative to the lateral side 121 of the body of the work vehicle, but may be oriented at any suitable range of angles (e.g., from 15 to 135 degrees along any section of the sweeping path). The cover 303 includes an arm pivot hole 304, an arm fastener hole 306, a hydraulic cylinder pivot hole 305, and a hydraulic cylinder fastener hole 307. In additional embodiments of the cover assembly, more or fewer holes may be included to secure certain members to the cover 303. The number and kinds of holes may differ to accommodate certain fixtures (e.g., depending on the type of connection). While only one configuration is described in detail here, it should be noted that additional configurations may be utilized.

The hydraulic cylinder 230 is coupled to cover 303 by inserting the pin 212 through cover hole 306 and into the first end 238 of the hydraulic cylinder 230. An anti-rotation mechanism 321 is configured to couple the pin 212 to the cover 303 via a fastener 323 (e.g., head lock screw, barrel nut, threaded screw, etc.) that extends through cover hole 307. The anti-rotation mechanism 321 blocks rotation of the pin 212, thereby enabling the hydraulic cylinder 230 to rotate about pin 212, which extends through the opening 236 at the first end 238 of the hydraulic cylinder 238. Fastener 323 is coupled to the cover 303 by a nut 324 with washers 324 disposed on opposite sides of the anti-rotation device. Collectively, these components form a first mount that mounts a first end of the hydraulic cylinder to the lateral side of the body of the work vehicle. In additional embodiments the anti-rotation mechanism 321 may be omitted.

The arm 210 is coupled to the cover 303 by inserting pin 212 through the cover hole 304 and an opening 216 in the first end 218 of the arm 210. An anti-rotation mechanism 321 is configured to couple the pin 212 to the cover 303 via a fastener 323 (e.g., head lock screw, threaded screw, etc.) that extends through the cover hole 306. The anti-rotation mechanism 321 blocks rotation of the pin 212, thereby enabling the arm 210 to rotate about the pin 212, which extends through the opening 216 at first end 218 of arm 210. The fastener 323 is coupled to the cover 303 by a nut 324 with washers 324 disposed on opposite sides of the anti-rotation device. Collectively, these components form a second mount that mounts a first end of the arm to the lateral side of the body of the work vehicle. In additional embodiments, the anti-rotation mechanism 321 may be omitted.

The hydraulic hoses 231 are configured to connect at one end to the hydraulic cylinder 230 and to connect to connectors 233 at the other end. The connectors 233 are connected to respective hydraulic lines that extend through to the lateral side 121 of the body of the work vehicle and are configured to transfer fluid to and/or from a hydraulic source. In the illustrated embodiment, the hydraulic hoses 231 are coupled to the deflector 310, thereby positioning the connectors 233 to be housed in the housing form between the deflector 310. Further, the connectors may be entirely enclosed inside the housing formed between the deflector 310, the cover 303, and the lateral side of the body of the work vehicle. As such, the housing may be large enough to house the connectors and/or other suitable components.

Figure 7:
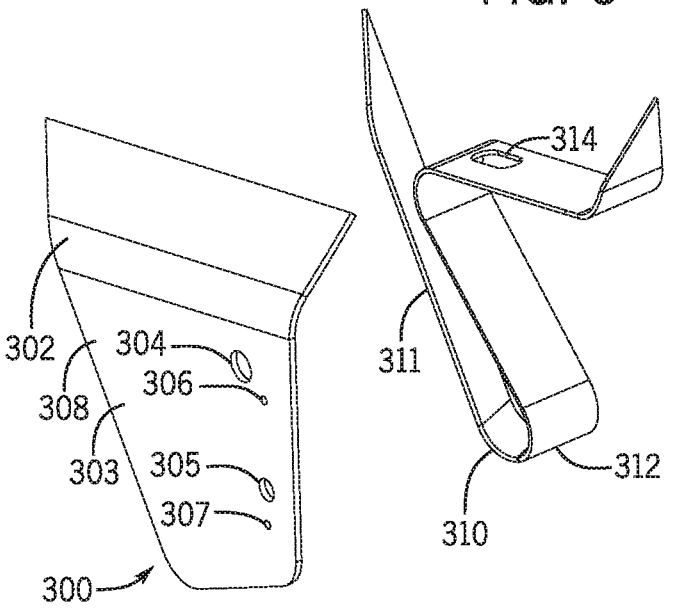
FIG. 7 is an exploded view of the cover assembly of FIG. 6.

FIG. 7 is an exploded view of the cover assembly of FIG. 6. As illustrated, the cover assembly 300 includes a cover 303 and a deflector 310. The cover 303 has a first portion 301 that is substantially flat and an angled portion 302 extending laterally outward from the lateral side 121 of the body of the work vehicle to the substantially flat portion 301. Furthermore, the cover 303 may vary to accommodate the rotatable elements, the tubing system (e.g., hydraulic cylinder tubing), and/or other suitable members of various sizes and shapes. Moreover, the cover 303 includes an arm pivot hole 304, an arm fastener hole 306, a hydraulic cylinder pivot hole 305, and a hydraulic cylinder fastener hole 307. In additional embodiments of the cover assembly, more or fewer holes may be included to secure certain members to the cover 303. The number and kinds of holes (e.g., depending on the type of connection) to accommodate certain fixtures may differ. While only one configuration is described in detail here, it should be noted that additional configurations may be utilized.

The deflector 310 is includes an opening 314 to couple an end of the hydraulic hoses to the deflector 310. In additional embodiments, the opening(s) 314 may be placed in any other suitable location. Furthermore, the deflector 310 follows the front edge of the cover 303 and then curves inside the cover 303 to form a sweeping shape. The cover and the deflector form part of a housing between the deflector 310, a portion of the cover 303, and the lateral side of the body of the work vehicle. In the current embodiment, the sweeping shape is collectively formed by the angled section 311 and curved perpendicular section 312 of the deflector 310. The sweeping shape is an "L-like" shape, but in other embodiments, the deflector may form a rectangular, triangular, or zig-zag shape, for example, such that a housing is formed between the deflector 310, a portion of the cover 303, and the lateral side of the body of the work vehicle.

The angle of the sweeping surface of the deflector is about 90 degrees relative to the lateral side 121 of the body of the work vehicle, but may be oriented at any suitable range of angles (e.g., from 15 to 135 degrees along any section of the sweeping path). The cover 303 includes an arm pivot hole 304, an arm fastener hole 306, a hydraulic cylinder pivot hole 305, and a hydraulic cylinder fastener hole 307. In additional embodiments of the cover assembly, more or fewer holes may be included to secure certain members to the cover 303. The number and kinds of holes may differ (e.g., depending on the type of connection) to accommodate certain fixtures. The deflector 310 includes the opening 314 to couple the hydraulic hoses to the deflector 310, thereby positioning the connectors to be housed in the housing formed between the deflector 310, the lateral side of the body of the work vehicle, and the cover 303.

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. An accessory mounting system for a work vehicle, comprising:

a tubing system positioned on a lateral side of a body of the work vehicle; and a cover assembly comprising a cover and a deflector, wherein the cover assembly is directly coupled to the lateral side of the body of the work vehicle, at least a portion of the cover is positioned laterally outward from the tubing system such that a portion of the tubing system is disposed between the lateral side of the body of the work vehicle and the portion of the cover, the deflector is configured to block debris from contacting the tubing system, and the deflector comprises one or more openings configured to receive one or more tubing elements of the tubing system.

2. The accessory mounting system of claim 1, wherein the tubing system comprises a plurality of hydraulic lines.

3. The accessory mounting system of claim 1, comprising a first mount extending from the lateral side of the body of the work vehicle, wherein the first mount is configured to couple to a first end of a rotatable component to rotatably couple the rotatable component to the body of the work vehicle, and the portion of the cover is positioned laterally outward from the first mount such that the first end of the rotatable component is disposed between the lateral side of the body of the work vehicle and the portion of the cover while the first end of the rotatable component is coupled to the first mount.

4. The accessory mounting system of claim 3, wherein the rotatable component comprises a hydraulic cylinder configured to drive movement of an accessory assembly.

5. The accessory mounting system of claim 4, wherein the tubing system comprises at least one hydraulic line, and the at least one hydraulic line is fluidly coupled to the hydraulic cylinder.

6. The accessory mounting system of claim 3, wherein the cover assembly comprises a second mount configured to mount to the first end of the rotatable component.

7. The accessory mounting system of claim 3, wherein the rotatable component comprises an arm of an accessory assembly.

8. The accessory mounting system of claim 1, wherein the deflector is positioned forward of the portion of the tubing system relative to a direction of travel of the work vehicle.

9. The accessory mounting system of claim 1, wherein the deflector supports the tubing system.

10. The accessory mounting system of claim 1, wherein the portion of the cover is substantially flat, and the cover comprises an angled section extending laterally outward from the lateral side of the body of the work vehicle to the portion of the cover.

11. A work vehicle, comprising:

a tubing system positioned on a lateral side of a body of the work vehicle; and a cover assembly directly coupled to the lateral side of the body of the work vehicle, wherein the cover assembly comprises:

a cover, wherein at least a portion of the cover is positioned laterally outward from the tubing system such that a first portion of the tubing system is disposed between the lateral side of the body of the work vehicle and the portion of the cover; and a deflector configured to block debris from contacting the tubing system, wherein the deflector comprises one or more openings configured to receive one or more tubing elements of the tubing system.

12. The work vehicle of claim 11, wherein the deflector supports the tubing system.

13. The work vehicle of claim 11, wherein the deflector is directly coupled to the lateral side of the body of the work vehicle and to the cover to form an enclosure enclosing a second portion of the tubing system, and the second portion of the tubing system is positioned on an opposite side of the deflector from the first portion of the tubing system.

14. The work vehicle of claim 11, wherein the deflector is positioned forward of the first portion of the tubing system relative to a direction of travel of the work vehicle.

15. The work vehicle of claim 11, wherein the deflector comprises a plate following a forward edge of the cover, and the plate is coupled to the lateral side of the body of the work vehicle.

16. The work vehicle of claim 11, comprising a first mount extending from the lateral side of the body of the work vehicle, wherein the first mount is configured to couple to a first end of a rotatable component to rotatably couple the rotatable component to the body of the work vehicle, and the portion of the cover is positioned laterally outward from the first mount such that the first end of the rotatable component is disposed between the lateral side of the body of the work vehicle and the portion of the cover while the first end of the rotatable component is coupled to the first mount.

17. A cover assembly for a work vehicle, comprising:

a cover configured to couple to a lateral side of a body of the work vehicle, wherein at least a portion of the cover is positioned laterally outward from a tubing system such that a portion of the tubing system is disposed between the lateral side of the body of the work vehicle and the portion of the cover, and a deflector configured to couple to the lateral side of the body of the work vehicle, wherein the deflector is configured to block debris from contacting the tubing system, and the deflector comprises one or more openings configured to receive one or more tubing elements of the tubing system.

18. The cover assembly of claim 17, wherein the deflector is configured to directly coupled to the lateral side of the body of the work vehicle, the deflector is directly coupled to the cover, the cover and the deflector form a portion of an enclosure enclosing a second portion of the tubing system, and the second portion of the tubing system is positioned on an opposite side of the deflector from the portion of the tubing system.

19. The cover assembly of claim 17, comprising a first mount configured to extend from the lateral side of the body of the work vehicle, wherein the first mount is configured to couple to a first end of a rotatable component to rotatably couple the rotatable component to the body of the work vehicle, and the portion of the cover is positioned laterally outward from the first mount such that the first end of the rotatable component is disposed between the lateral side of the body of the work vehicle and the portion of the cover while the first end of the rotatable component is coupled to the first mount.

20. The cover assembly of claim 17, wherein the deflector is positioned forward of the portion of the tubing system relative to a direction of travel of the work vehicle.

* * * * *